US005342189A

United States Patent [19]

Inamura et al.

[11] Patent Number: 5,342,189

[45] Date of Patent: Aug. 30, 1994

[54] EXTRUSION DIES

[75] Inventors: Akira Inamura, Susono; Masafumi Kaneko, Tokyo; Nobuyuki Hasegawa, Susono, all of Japan

[73] Assignees: Mitsubishi Aluminum Co., Ltd., Tokyo, Japan; Thermalex, Inc., West Montgomery, Ala.

[21] Appl. No.: 955,057

[22] Filed: Oct. 1, 1992

[51] Int. Cl.[5] ..... B29C 47/00

[52] U.S. Cl. ..... 425/461; 425/467; 425/468

[58] Field of Search ..... 425/380, 461, 463, 464, 425/467, 468

[56] References Cited

U.S. PATENT DOCUMENTS

| | | | |
|---|---|---|---|
| 353,681 | 12/1886 | Hurlbut | 425/467 |
| 1,725,959 | 8/1929 | Heath | 425/467 |
| 3,227,103 | 1/1966 | Schafer | 425/463 |
| 3,255,487 | 6/1966 | Nieuwenhuysen | 425/467 |
| 3,608,138 | 9/1971 | Marcovitch | 425/467 |
| 3,778,217 | 12/1973 | Bustamante et al. | 425/467 |
| 3,923,444 | 12/1975 | Esper et al. | 425/461 |
| 4,113,411 | 9/1978 | Terragni | 425/467 |
| 4,668,176 | 5/1987 | Zeibig et al. | 425/464 |
| 4,820,146 | 4/1989 | Inoue et al. | 425/461 |
| 5,061,163 | 10/1991 | Kennedy | 425/461 |

FOREIGN PATENT DOCUMENTS

| | | |
|---|---|---|
| 0398747 | 11/1990 | European Pat. Off. . |
| 0558288 | 9/1993 | European Pat. Off. . |
| 64-31571 | 2/1989 | Japan . |
| 1-156405 | 6/1989 | Japan . |
| 3-295 | 1/1991 | Japan . |
| 3-193209 | 8/1991 | Japan . |
| 5-57337 | 3/1993 | Japan . |

*Primary Examiner*—Charles S. Bushey

*Attorney, Agent, or Firm*—Oblon, Spivak, McClelland, Maier & Neustadt

[57] ABSTRACT

An insert type extrusion die is presented for making small parts for use in electrical, automotive and other industries for manufacturing small component parts. The application of the invented die is illustrated for making multi-cavity flat aluminum tubes, which are used for small heat exchanger components, in automotive air-conditioners, condensors and radiators. The insert die is composed of a male die section having a protrusion part and a female die section having a die cavity is held detachably in a die holder. The male section is a roughly rectangular plate-shaped component, and has an integrally formed twist prevention region which is inserted into the receiver groove of the female section which is integrally formed thereon. The protrusion part defines the cavity shape of the multi-cavity flat tube, and the female section has the die cavity of the required cross sectional shape to define the outer shape of the tube. Because the male section is made as a small independent part, the male section is not only replaceable readily, but the extrusion pressure is low because the port area can be made large compared with the insert dies of the conventional type. The invented insert die is therefore durable and retains the original mechanical precision of a new die during its long service life. The cost of manufacturing the insert die is low because the male section is simple shaped and can be fabricated by such precision fabrication techniques as electric discharge machining.

30 Claims, 6 Drawing Sheets

EXTRUSION DIES

BACKGROUND OF THE INVENTION

1. Field of the Invention

The present invention relates to small extrusion dies which are suitable for the production of small objects for use in electrical, automotive and related manufacturing industries, and a method for their use. Such objects are multi-cavity flat tubes made of aluminum and aluminum alloys which are used in heat exchangers, for example, evaporators for automotive air-conditioners, condensers, radiators and other related products. The features of the invented dies are that they are easier to manufacture compared with the conventional extrusion dies and that they provide a long service life, by maintaining the dimensional accuracy even after a prolonged use.

2. Background Art

Extrusion process is explained first with reference to FIG. 1. In general, a process of forming an object by extrusion includes the following steps: placing a billet 51 in a receptacle means, generally referred to as a container 50; pressing the billet 51 with a stem 53 toward an exit opening 54 or a depressed section; flowing the material constituting the billet 51 through a space defined by the opening 54 (die cavity), and in some cases also by a mandrel which is inserted into the opening, in which the space formed in between the opening and the mandrel is shaped in a shape of the profile of the object desired. Through such a process, an object having the desired cross sectional shape is obtained.

One important feature of the extrusion process is that a product of a very complex cross sectional shape can be obtained through one processing step of exerting a compressive pressure around the billet placed in the container, and squeezing the material out of the shaped die cavity.

For this reason, extrusion process is applied also to forming of aluminum alloys to produce multi-cavity flat tubes for use in heat exchangers such as evaporators for automotive air-conditioners, condensors and radiators.

In the following, the features of the present invention will be explained with particular reference to the production of multi-cavity flat tubes by the conventional extrusion process and by the method of the present invention. However, it will be understood that the present invention is by no means limited to this particular application.

FIG. 2 illustrates the shape of a multi-cavity flat tube produced by the above presented conventional extrusion process. Such process is disclosed in Japanese Patent Application First Publication JPA S64(1989)-31571 and Japanese Utility Model Application, Second Publication JUA H3(1991)295.

Extrusion dies suitable for the production of such shapes are known to be integral bridge dies or insert dies.

FIG. 3 illustrates an example of the integral bridge type dies. Such a die 60 is composed of a cylindrical body which includes the bridge part for supporting a female die and male die which are formed integrally with the rest of the die body. There is a die cavity 61 which run through the die 60 parallel to the die axis from one surface to the opposite surface of the die 60. The cavity 61 forms an integral part of the shape forming opening which is constituted by the male and female dies. Therefore, such a die is composed of a die body which includes both male and female dies within one body, and may be made up of a number of sections. (In the case of the die shown in FIG. 3, the die body has four sections.) For such a die, if one section of the die is damaged, the entire die body becomes defective, because it is not possible to replace one section of a die body, and in some cases, the die 60 itself may have to be replaced.

To overcome such problems associated with the bridge dies, insert type dies were developed. With reference to FIG. 4, an insert die is composed of a die holder 80, and at least one die body 70 which can be inserted into or taken out of the die holder 80 freely. The die holder 80 usually has a plurality of openings 81 for receiving a die body 70 in each opening 81. The die body is comprised of two engaging cylindrical sections. The first section (female type) has a certain cavity shape, and the second section (male type) has a protrusion of another shape which is inserted into the first section. Therefore, if the cavity of one of the die bodies 70 becomes defective, it is necessary to replace only the section damaged or only the die body 70 concerned.

The construction of the die body 70 of the insert dies will be explained in more detail, with reference to FIGS. 5 to 7. In all the descriptions which follow, the surfaces and directions are referenced with respect to the direction of travel of the material being extruded. In the case of FIG. 5, the billet is placed against the second section **70*b* (referred to as the male section 70*b*), and is extruded toward the first section 70*a* (referred to as the female section 70*a***). The entry-side is defined as the side from which the material enters the die, and the exit-side is defined as the side from which the material leaves the die.

Generally the die body 70 is a roughly cylindrical body as shown in FIG. 5 and consists of two parallel sections **70*a* and 70*b* whose flat surfaces are disposed transverse to the axis of the die body 70. The first section 70*a* has two concentric parts: an outer depressed part 71 of a large circular shape (female mating part whose internal wall surface 71*a* fits with the wall surface of the male section which will be described later); and an inner depressed part 72 having a four leaf shape, which is made by machining out the central portion of the outer depressed part 71. An elongated opening 73 is formed along a diametrical axis of the section 70*a*. With reference to FIG. 6, the female section opening 73 consists of an extrusion cavity 73*a* at the exit-side of the four leaf part 72, and an exit region 73*b* which has a larger opening than the die cavity and which communicates with the entry-side surface of the section 70*a*. In this particular example, the cross sectional shape of the die cavity 73*a* transverse to the die axis is shown, in FIG. 5, to be a wide slit with the corners rounded. It is also shown in the same figure that there is a pair of locating holes 75 disposed diametrically opposite to each other, and a pair of threaded holes 74** which are disposed similarly.

The second section **70*b* is provided with a male mating part 76, on the exit-side surface, to fit with the female mating part 71*a* described above, along all its periphery. There is an integrally formed comb-shaped part 77 (FIG. 5), which extends along parallel to the female section opening 73, and comprised of a plurality of protrusions. The comb-shaped part 77 functions as a mandrel when inserted into the die cavity 73*a* of the section 70***a*. The male section opening 78 is formed along the extrusion direction following the contours of the comb-shaped part 77. The male section opening 78 communicates with both the entry-side surface and the exit-side surface of the second die section 70*b*. When the die sections 70*a* and 70*b* are joined together, the male section opening 78 forms a container and acts as the billet chamber in conjunction with the four leaf shaped depressed part 72 of the second section 70*a*. To prevent misalignment of the two sections, 70*a* and 70*b* of the die body 70, two locating pins 80 are made to align with the two locating holes 75, and the threaded holes 79 of the second section 70*b* are aligned, respectively with the threaded holes 74 of the first section 70*a*.

Manufacturing of the male dies is performed using the methods which are routine to those skill in the field of extrusion. The processing includes the following steps:

1. Machining such as lathe cutting and drilling which requires the use of cutting bits;
2. Heat treatments, including hardening;
3. Polishing; and
4. Electric discharge machining (EDM): after the hardening heat treatment process above, the dies cannot be machined by the cutting bits, so the dies are fabricated by means of electric arc discharge from electrodes such as Cu electrode while washing off the debris formed by the discharge with oil.
5. Wire discharge cutting which is a type of EDM.

There are serious problems associated with such processing steps mentioned above, in particular, the lathe and milling operations require a large number of processing steps and are time consuming. Approximately twenty steps, over a period of about ten hours, are required from the start to the completion of making a male die. Female dies also require about the same number of steps over a period of about six hours. Practical steps necessary would be evident to those skilled in the art from the complex shape of the die sections illustrated in FIG. 5.

There are additional problems in the case of the insert dies as described below.

(i). The size of the entry port for aluminum extrusion is set by experience, on the basis of the die strength. However, the required cross sectional area is relatively small for most aluminum extrusions, and the required extrusion pressure is high in relation to the strength of the die material. High stresses are imposed on the die, and consequently, the die suffers slight permanent distortions.

Such distortions affect the precise fitting of the two sections (male and female sections) of the die, resulting in the loss of dimensional accuracy of the product. The accuracy of alignment due to pins and screws is also affected. Even if one section is replaced with a new section, the combination of new and old dies cannot reproduce the original dimensional accuracy. When the distortion is allowed to continue, the die must eventually be discarded.

(ii) Because the dies are made of two separate sections, alignment devices such as pins and screws are required. It is necessary to fabricate such parts, but it is difficult to attain the precision required for the pin holes and threaded holes by lathe machining. Wear is introduced during the operation, because every time a die is disassembled or assembled the pins are removed or driven into the dies, thereby accelerating the loss of service life of the die.

(iii) Heat treatment processes are required which introduces thermal distortions in the dies, making it difficult to maintain the required precision, and because of the complexity of the die shape, it is difficult to completely correct such distortions.

(iv) Many machine shops making extrusion dies lack the ability to accurately measure the internal diameter of the female die section, thus making it difficult to manufacture a high precision joint part by lathe machining.

(v) To improve wear resistance, it is desirable to coat the surfaces of the die with known abrasion resistant coating, but it is difficult to coat the die structure, including the pin holes, uniformly with the applicable coating techniques. If the coating thickness in the interior surfaces of pin holes becomes non-uniform, the alignment accuracy of the male and female dies becomes poor.

(vi) The suitable die materials include such hard materials as heat treatable tool steels and highspeed steels. However, because of the large size of the most insert dies, it is not preferable to make insert dies with such hard materials which are susceptible to cracking. The forces responsible for causing such cracking in insert dies arise from the impact of initial loading as well as from the extrusion process.

Therefore, there has long been an outstanding need for the development of durable extrusion dies which provide long service life without causing fracture, wear and distortions due to extrusion processes, which accept coating processing uniformly and easily thereon and which provide a long service life by maintaining the initial machining precision of the die components.

SUMMARY OF THE INVENTION

The objective of the present invention is therefore to present a new insert die based on a design concept of an independent male section rather than an integrated male section. The invented die section provides extruded products of high dimensional precision and durable service life. The male insert section is easily replaceable and is economical to produce with the use of such precision fabrication techniques as electric discharge machining.

An insert type extrusion die is presented for extruding a material which travels in an extrusion direction from the entry-side of the die to the exit-side of the die. The extrusion die comprises a male section having a protrusion part, coupled to a female section held detachably in a die holder, having a die cavity into which the protrusion part of the male section is insertingly disposed. The male section comprises the protrusion part formed integrally with a male section body, and an alignment part for aligning and locking the relative position of the male section with respect to the female section. The female section comprises a die cavity for inserting the protrusion part of the male section; an exit region disposed at the exit-side communicating with the die cavity disposed at the entry-side of a cylindrical body; and a receiving groove for aligning and holding the male alignment part of the male section.

The material for manufacturing the extrusion die is chosen from a group of materials consisting of heat treatable tool steels and highspeed tool steels. The surfaces of the die is coated with a hard coating, such as a nitride coating.

An embodiment of the present invention relates to the protrusion part, extending from the exit-side of the male section, is formed at a protruded region of the male section which opposes the die cavity when the male section is coupled with the female section, and is formed between a top and a bottom flowing regions extending from the entry-side to the exit side of the protruded region of the male section. The protrusion part is comb-shaped and consists essentially of a plurality of elongated protrusions disposed on the end of the protrusion part at predetermined intervals.

The extrusion die as described above has a female section provided with: a cross-shaped grooves at the entry-side thereof; and a wide chamber region of a rectangular shape, formed transversely to the extrusion direction and acting as a billet chamber; with a receiver groove part fabricated transversely to the chamber part.

The die cavity is shaped as a wide slit-shape, and an exit region communicating with the die cavity is formed in the extrusion direction from the entry-side to the exit-side of the female section, and along the center axis of the female section; the exit region is shaped in a topless pyramidal shape and enlarging toward the exit-side of the female section; is formed coaxially with the die cavity The female section, held in the die holder, is provided with a notch part to prevent twisting thereof during the extrusion process.

PREFERRED EMBODIMENTS OF THE INVENTION

Figure 8:
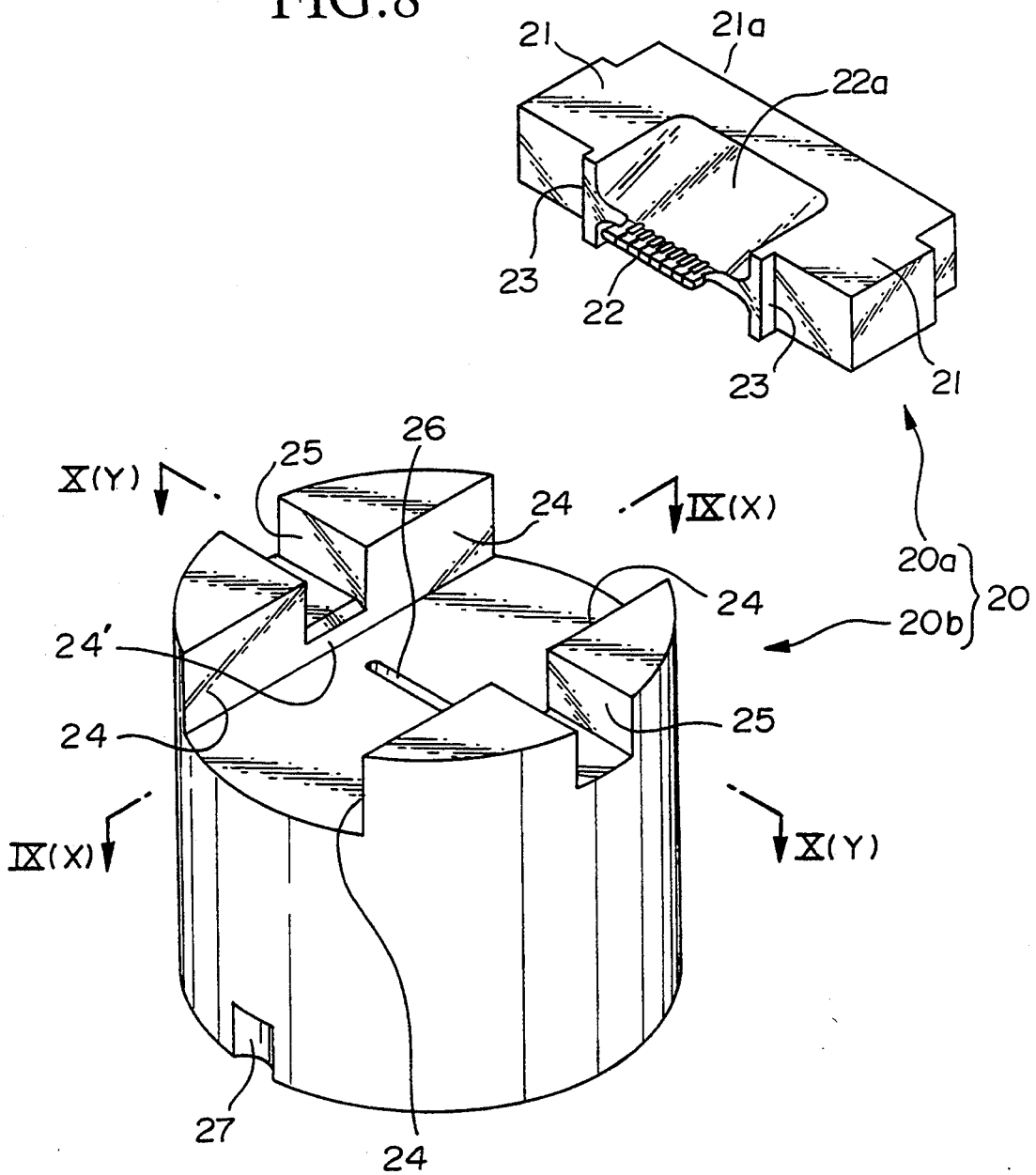
FIG. 8 is a schematic drawing of an insert die according to the present invention.
Figure 9:
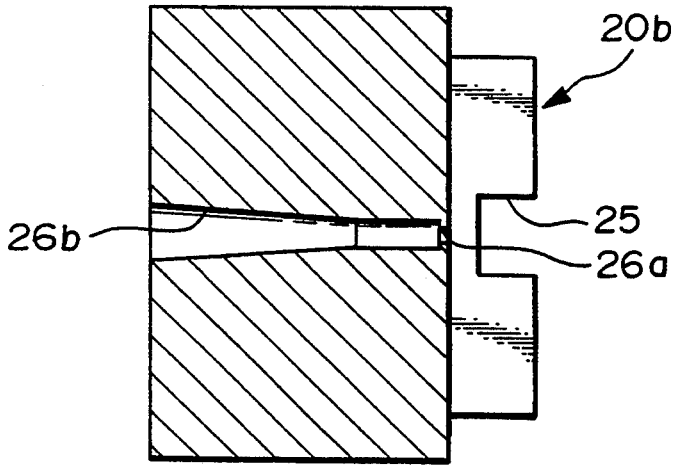
FIG. 9 is a cross sectional view of the die taken along a plane VIII—VIII in FIG. 8.
Figure 10:
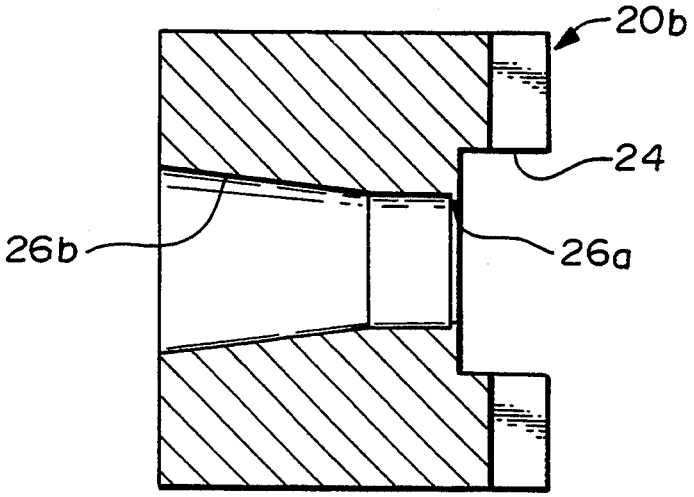
FIG. 10 is a cross sectional view of the die taken along a plane X—X in FIG. 8.

An embodiment of the present invention of the extrusion dies is presented in FIGS. 8 to 10. The die 20 shown is used to produce multi-cavity flat tubes for heat exchanger applications, and consists of a roughly rectangular male die section 20*a*, and a roughly cylindrical female die section 20*b*.

The male section 20*a* will be described first. The male section 20*a* is fabricated from a plate of roughly rectangular shape to form a male section main body 21*a*, and comprises various parts fabricated symmetrically with respect to the extrusion direction, but the description is given only for one side of the male section. The male section 20*a* comprises:

(a) a twist prevention region 21 which is fabricated integrally with a transversely formed protrusion part which merges with the plate body to form a sloping surface disposed on the broad side surface of the twist prevention region 21, thus forming a smoothly sloping flowing region 22*a* extending in the metal flow direction;

(b) a comb-shaped part 22 which is formed on the transverse protrusion part of the broad side surface whose width is thinner than the thickness of the plate 20*a;*

(c) a topless pyramid-shaped blending region which blends the surface of the comb-shaped part 22 with the flowing region 22*a;* and (d) a support region 23 formed on the transverse edges of the comb-shaped part 22 to prevent sideways shift of the male section 20*a*.

The twist prevention region 21 and the support region 23 constitute the coupling region when coupling the male section 20*a* with the female section 20*b*.

Figure 1:
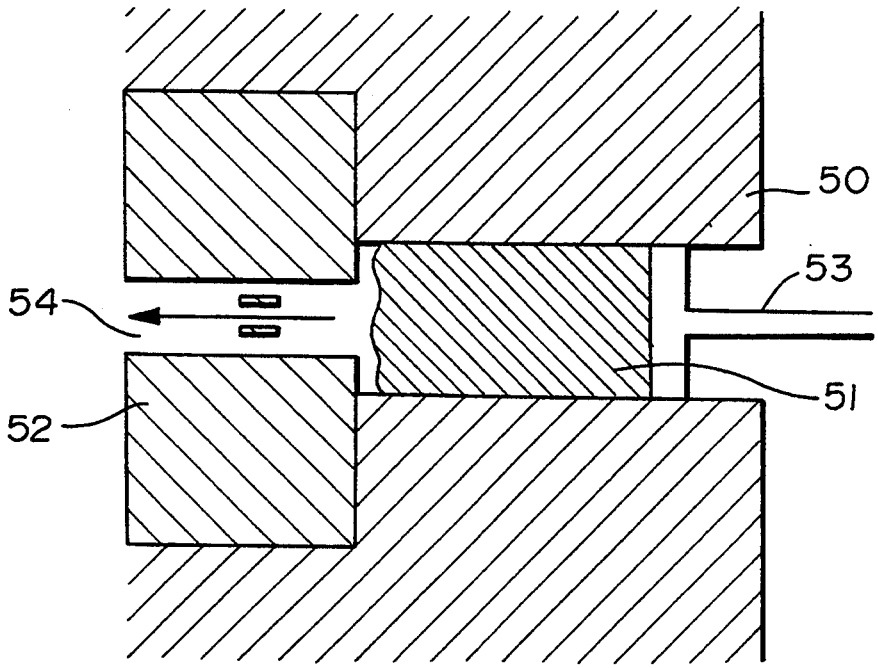
FIG. 1 (PRIOR ART)
FIG. 1 is an illustration of the conventional method of extrusion processing.
Figure 2:
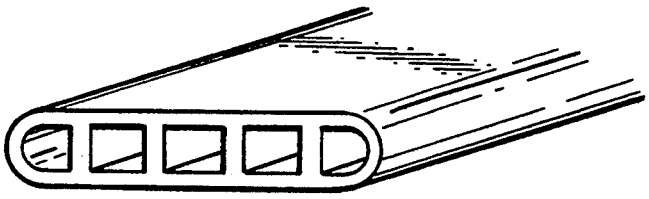
FIG. 2 is an example of a product which is made by an extrusion processing.
Figure 3:
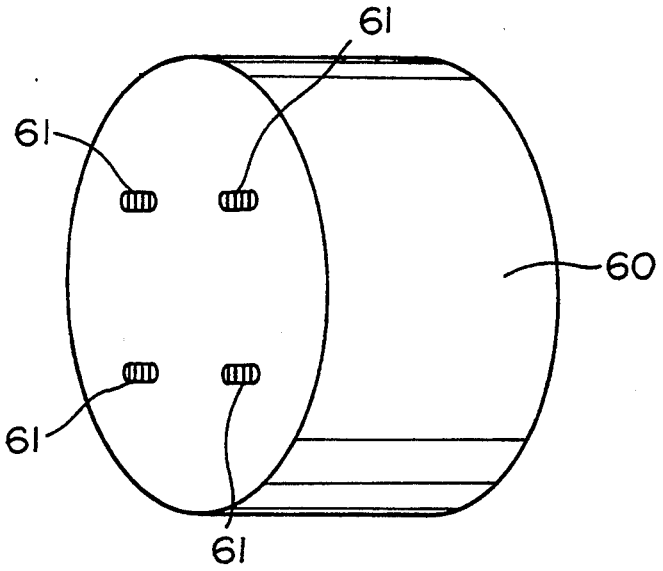
FIG.3 (PRIOR ART)
FIG. 3 is a schematic drawing to illustrate a conventional bridge type die.
Figure 4:
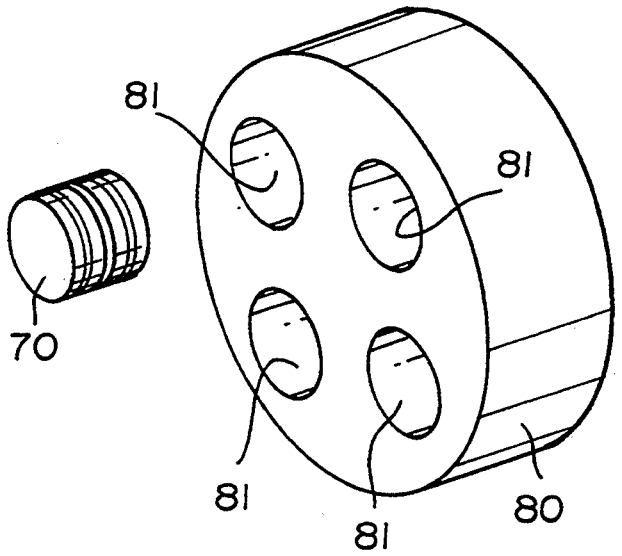
FIG.4 (PRIOR ART)
FIG. 4 is a schematic drawing to illustrate a conventional insert type die and a holder therefor.

The comb-shaped part 22 consists essentially of a plurality of regularly spaced protrusions to define the number and the shape of openings required in the flat tube (refer to FIG. 2), in cooperation with the die cavity of the female section which will be described next.

The female section 20*b* is fabricated from a roughly cylindrical body, and has a cross-shaped grooves (the depressed region) formed at its one end. The grooves serve the purpose of interlocking with the male die whose twist prevention region 21 is placed therein, as well as serve the purpose of forming a billet chamber. The depressed region consists essentially of a rectangular-shaped shallow chamber region 24 formed in the direction of extrusion and transverse to the extrusion axis, and a pair of transversely disposed receiver groove 25 for fitting the male section which is formed shallower and narrower than the chamber region 24 grooves. The receiver grooves 25 serve the purpose of preventing twisting of the male section 20*a* due to extrusion pressure, in conjunction with the support region 23.

The female section 20*b* includes a cavity opening 26 which is shaped like a wide slit, and which is formed transversely to the extrusion direction and extending from the surface of the chamber region 24 to the exit direction. The cavity opening 26 consists of a die cavity 26*a* and the exit region 26*b*, as shown in FIG. 9. The comb-shaped part 22 is inserted into the die cavity 26*a* and in cooperation therewith defines the cross sectional shape of the multi-cavity flat tube extrusion. The exit region 26*b* is formed coaxially continuous with the die cavity 26*a*, and enlarges toward the exit-side of the female section 20*b* to form a topless pyramid-shape at the exit-side surface of the female section 20*b*. The shape of the exit region is not restricted to this particular shape and other shapes such as rectangular shape can be used.

When the die is used to extrude a product, the twist prevention regions 21 of the male section 20*a* are placed in the receiver grooves 25 of the female section 20*b*. The support region 23 of the male section 20*a* is coupled to the stepped region 24' formed on the wall surface of the chamber region 24 directly adjacent the receiver grooves 25. By such a coupling of the male and female sections of the die, the shift of the male section 20*a* in both X- and Y-directions (reference to FIG. 8) is prevented.

The female section 20*b* is prevented from twisting during extrusion by means of the notch 27 formed on the wall region of the female section 20*b* at the exit-side end, as illustrated in FIG. 8.

In the conventional insert type extrusion dies, it is not desirable to make the large component sections from hard materials, because of the high probability of forming cracks therein. However, the component parts of the present invention are small, and it is possible to utilize tool steels used in hot working, high speed steels though not exclusively. The processing methods include grinding and polishing with surface grinders to remove any distortion of the starting material, followed by EDM and wire EDM to fabricate them into specific shapes. It is preferable to treat the surfaces of the fabricated parts with known surface treatment processes such as carburizing or nitriding, because such processes will prolong the service life of the dies. The material for the female section can be any conventional materials, such as heat treatable tool steels. This is because in the conventional die designs, the extrusion pressure tended to concentrate near the center portion and its surrounding region, making the die susceptible to deformation. However, as will be explained later, the die design of the present invention provides for a larger area in which the extrusion force is spread over, thereby avoiding the stress concentration in the central region of the die. Further, because the die sections are firmly housed in the die holder with precision alignment, the sections which interlock the male and female sections are not subject to significant transverse forces, thereby avoiding the exposure of such interlocking sections to the undesirable distortion forces. This can be demonstrated readily from the fact that the invented dies exhibit service life of about 30 to 40 tons of extrusions compared with the service life of the conventional die design of 10 to 15 tons of extrusions.

As should be apparent from the foregoing, and as shown in FIG. 8, the grooves 25 provide a fitting recess which receive portions (fitting portions) of the male section. In addition, as shown in FIG. 8, the female section includes shoulder portions at the intersection of the grooves 24,25. Adjacent the shoulder portions, stepped sections or stepped portions 23 of the male section are disposed such that the stepped sections provide engaging portions to further maintain proper positioning of the male section with respect to the female section.

The advantageous features of the present invention will be summarized below. Additional advantages not listed will be apparent to those skilled in the art of extrusion.

(1) The simple shapes of the components in the present invention are mostly fabricable with EDM. The EDM processes are efficient and economical processing methods, promoting high precision at low processing costs. In particular in the dies of the conventional designs, it was very difficult to fabricate the critical parts by EDM, such as the engaging region between the male and female sections which require the most precision. In contrast, the male section of the present invention is a plate shaped body having comb-shaped parts protruding from one edge. Therefore, fabrication of the male section can be performed on a surface grinder which will provide a dimensional precision of about $\pm 0.01$ mm, enabling to utilize an EDM process for making parts requiring high precision, such as the comb-shaped part, support part and coupling part.

(2) The simple extrusion die components utilized in the present invention are small size relative to the conventional components, thus enabling hard materials to be used without the fear of introducing cracks in the dies. For the male sections in particular, since the size can be restricted to the smallest possible size that contains the comb-shaped part and its support part, a suitably hard material can be chosen so as to improve the die performance such as strength and wear resistance. Further, the simple shapes enable the required surface treatment processes to be applied efficiently and uniformly.

(3) The dies designed according to the present invention enable precision alignment of the male and female die sections (assemble) without resorting to the conventional alignment means such as pins and screws. If one die section is damaged, it can be changed independently of the other die section, because the die sections are hardened by heat treatment processes and are fabricated with precision by means of EDM and other precision fabrication processes.

(4) The extrusion dies according to the present invention enable the coupling part to be fabricated by EDM, and further because the male and female sections are coupled in the direction of the X- and Y-axes, shown in FIG. 8, the alignment of the die sections is retained precisely during the extrusion process (i.e. a relative motion of the two sections is prevented)

Figure 5:
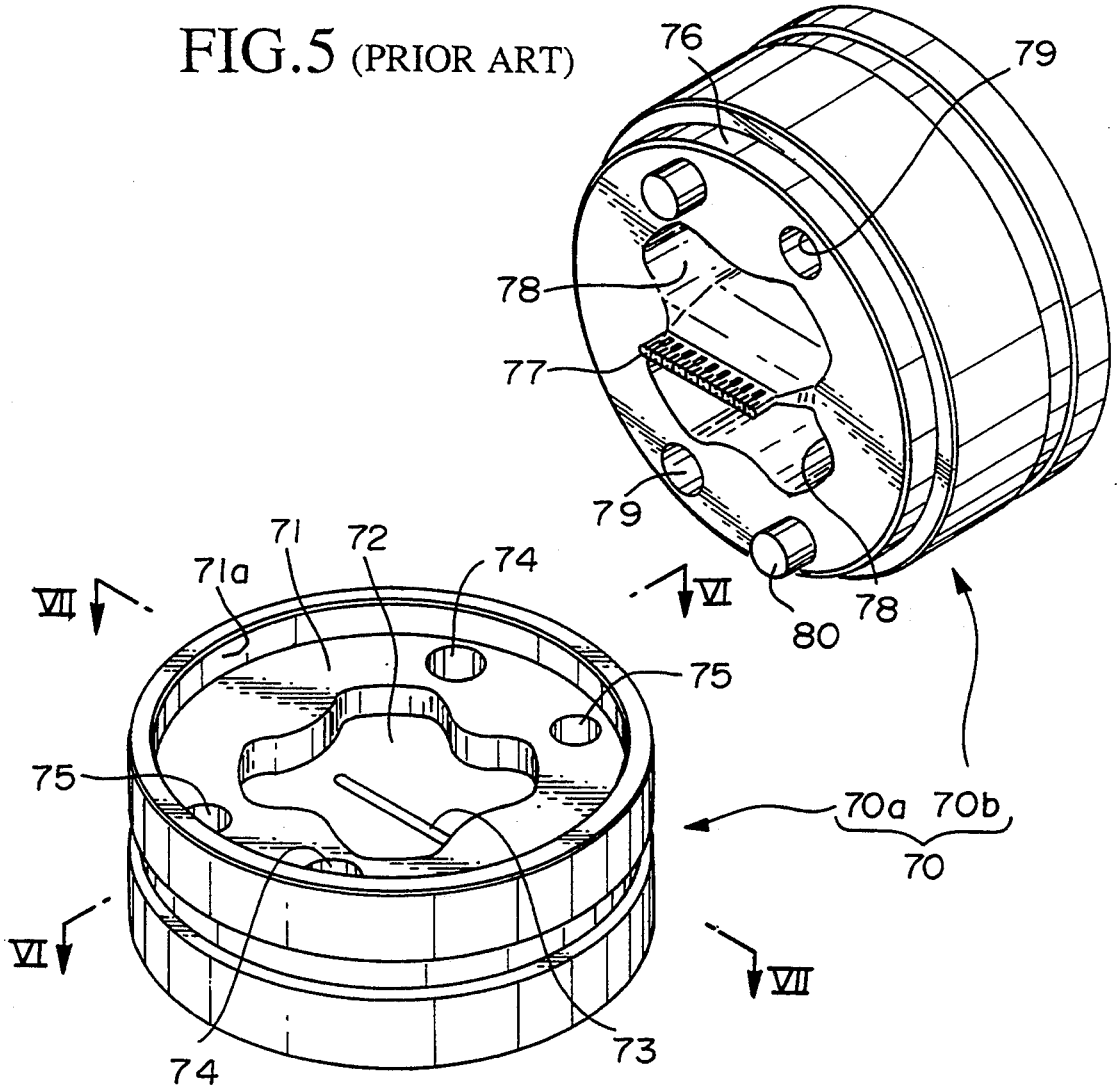
FIG.5 (PRIOR ART)
FIG. 5 is a perspective illustration to explain the details of a conventional insert type die.
Figure 6:
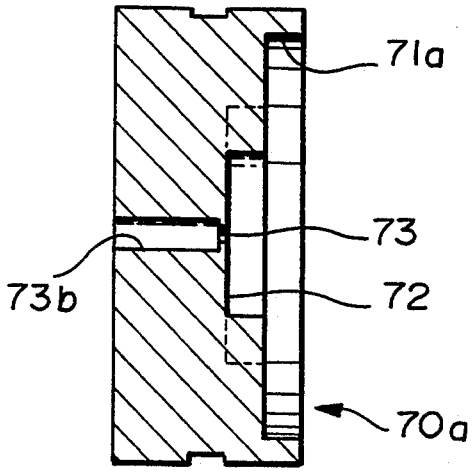
FIG.6 (PRIOR ART)
FIG. 6 is a cross sectional view of the die taken at a plane VI—VI in FIG. 5.
Figure 7:
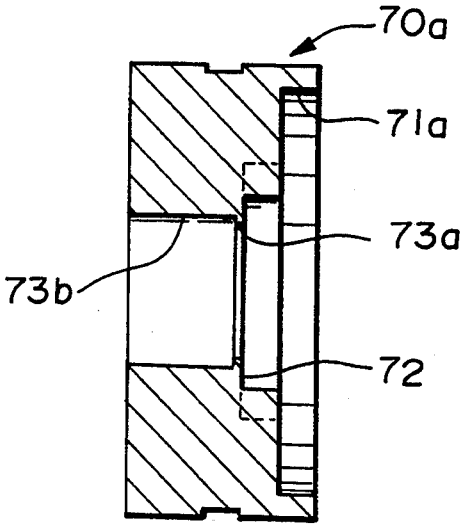
FIG.7 (PRIOR ART)
FIG. 7 is a cross sectional view of the die taken at a plane VII—VII in FIG. 5.

(5) The mandrels (FIG. 5) in the conventional dies are made as an integral part of the opening of a male section spanning across the diameter of the opening of the cylinder, and therefore, the billet chamber opening is restricted by the area of the cylindrical stock body. If the opening of the male section is made larger, the wall thickness of the male section becomes thin, making it susceptible to deformation. In contrast, the entry opening of the insert die of the present invention is located on the female section, and it can be enlarged (i.e. the port area can be made to be large), without the fear of deformation of the die, thus enabling a lower extrusion pressure to be used.

As described above, the extrusion dies according to the present invention are shaped uniquely and differently from the conventional dies, therefore, they can be manufactured easily, and essential treatments such as coating processes on the dies can be carried out uniformly and efficiently, thereby providing durable dies which can maintain high dimensional precision. Harder materials can be chosen for making the male sections compared with the conventional design of male sections. Therefore, the design method enables the production of extrusion dies of long service life, having abrasion resistance and without being affected by deformation due to extrusion pressure, thereby maintaining the original precision of newly commissioned dies during its long service life.

Theoretically, the dies can have a nearly permanent life when the coating is reapplied before it is worn off or peeled off from the dies.

The above preferred embodiment presents only an application of the design concept to a case of production of multi-cavity flat tubes. The basic concept can be applied to numerous other cases of production of extruded products of similar cross sectional shapes within the limitations expressed in the claims which follow. The design concept disclosed in the present invention is equally applicable to other complex shapes for which insert or mandrel type dies are necessary and when the dimensional accuracy must be maintained over a prolonged production period.

What is claimed is:

1. An insert type extrusion die comprising a plate-shaped male section coupled with a cylinder shaped female section held detachably in a die holder, for extruding a billet which is extruded by entering a die cavity from an entry-side to an exit-side of said die, said male section having a protrusion part, and said female section having a die cavity into which said protrusion part of said male section is insertingly disposed:

wherein said protrusion part of said male section is formed integrally with a male section main body and with an alignment part for aligning and locking the position of said male section with respect to said female section; and said female section includes said die cavity disposed on a billet chamber for holding an extrusion billet; an exit region disposed at the exit-side of said die cavity and communicating therewith; and a receiving groove for aligning and holding said male alignment part of said male section;

said male section further including a support region extending from said alignment part and in a direction from said entry-side toward said exit-side such that when said receiving groove receives said male alignment part, said support region extends into said female section immediately adjacent to a wall of said female section, whereby said male alignment part and said support region prevent relative movement between said male section and said female section.

2. An extrusion die as claimed in claim 1, wherein said male section is made of a material chosen from the group of materials consisting of tool steel for use in hot working and high speed tool steels.

3. An extrusion die as claimed in claim 1, wherein the surfaces of said die are coated with a hard coating.

4. An extrusion die as claimed in claim 3, wherein said hard coating is a nitride coating.

5. An extrusion die as claimed in claim 1, wherein said protrusion part extending from the exit-side of said male section main body, is formed at a protruded region of said male section, and is formed between a top and a bottom flowing regions extending from the entry-side to the exit side of said protruded region of said male section.

6. An extrusion die as claimed in claim 5, wherein said protrusion part is comb-shaped and consists essentially of a plurality of elongated protrusions disposed on the end of said protrusion part at a predetermined interval.

7. An extrusion die as claimed in claim 1, wherein said female section is provided with:

cross-shaped grooves at the entry-side thereof; and a wide chamber region of a rectangular shape, formed transversely to the extrusion direction and acting as said billet chamber, and a receiver groove part fabricated transversely to said chamber part.

8. An extrusion die as claimed in claim 7, wherein said die cavity is shaped as a wide slit-shape and said exit region communicating therewith is formed in the extrusion direction and along the center axis of said female section from the entry-side to the exit-side of said female section; and said exit region is formed coaxially with said die cavity and is topless pyramid-shaped, and enlarges toward the exit-side of said female section.

9. An extrusion die as claimed in claim 7, wherein said female section is provided with a notch part to prevent twisting thereof when said female section is held in said die holder.

10. The extrusion die of claim 1, wherein said support region includes a surface extending perpendicular to said receiving groove of said female section.

11. The extrusion die of claim 1, wherein said support region includes a surface formed along edges of said protrusion part.

12. An insert type extrusion die comprising:

a male section coupled with a female section for extruding a billet entering a die cavity from an entry-side to an exit-side of the die, said male section including a protrusion part, and said female section including a die cavity into which said protrusion part of said male section is insertingly disposed;

said female section including first, second and third grooves, said first and second grooves receiving end portions of said male section, and wherein said male section is further provided with a stepped section which extends in an extrusion direction, said stepped section extending into said third groove of said female section.

13. The insert type extrusion die of claim 12, wherein said third groove is disposed between said first and second grooves and separates said first and second grooves.

14. The insert type extrusion die of claim 12, wherein said third groove of said female section has a depth greater than a depth of said first groove of said female section, and wherein said third groove includes a side wall, and said stepped section extends into said third groove immediately adjacent said side wall of said third groove.

15. The insert type extrusion die of claim 12, wherein said third groove has a depth greater than that of said first groove and said first groove is open into said third groove such that a wall portion is provided between a deepest part of said third groove and a deepest part of said first groove, and wherein said stepped section of said male section is disposed adjacent said wall portion of said second groove.

16. The insert type extrusion die of claim 12, wherein said first and second grooves are open into said third groove, and wherein said third groove has a depth greater than said first and second grooves such that a pair of wall portions are provided in said third groove between a deepest part of said third groove and respective deepest parts of said first and second grooves, and wherein said male section includes a pair of said stepped sections which are respectively disposed immediately adjacent said pair of wall portions when said male section is received by said female section.

17. An insert type extrusion die comprising:

a plate-shaped male section including first and second ends;

a female section including a die cavity, the female section further including first and second grooved portions respectively receiving said first and second ends of said male section;

said plate-shaped male section further including a protrusion part which is insertingly received by the die cavity of said female section when said first and second ends of said male section are received by said first and second grooved portions of said female section;

said plate-shaped male section further including a sloping flowing region, said sloping flowing region having a greater thickness at an upstream location with respect to an extrusion direction and a smaller thickness at a downstream location with respect to said extrusion direction, said thickness at said upstream location being at least approximately the same as a thickness of remaining portions of said plate-shaped male section, and wherein said protrusion part is disposed at an end of said sloping flowing region.

18. The insert type extrusion die of claim 17, wherein said female section further includes a third groove and said male section further includes a stepped portion extending into the third groove of said female section, and wherein said third groove has a greater depth than said first and second grooved portions, and further wherein said third groove separates said first and second grooved portions.

19. An extrusion die insert to be detachably held by a die holder, said extrusion die insert comprising:

a female die of a generally cylindrical shape having opposite end surfaces and including a die cavity formed therein so as to open into one of said end surfaces and a discharge passageway communicated with said die cavity and opening into the other of said end surfaces, said female die including a fitting recess having a generally channel-shaped cross-section formed in said one end surface thereof; and a male die of a generally rectangular parallelepiped plate shape having opposite faces and an end face joining said opposite faces, said male die having a protrusion part formed on said end face, said opposite faces and said end face having portions defining a fitting portion, said male die being associated with said female die with said protrusion part being fitted in said die cavity and with said fitting portion being fitted in said fitting recess.

20. An extrusion die insert to be detachably held by a die holder, said extrusion die insert comprising:

a female die of a generally cylindrical shape having opposite end surfaces and including a die cavity formed therein so as to open into one of said end surfaces and a discharge passageway communicated with said die cavity and opening into the other of said end surfaces, said female die including a fitting recess having a generally channel-shaped cross-section formed in said one end surface thereof; and a male die of a generally plate shape having opposite faces and an end face joining said opposite faces, said male die having a protrusion part formed on said end face, said opposite faces and said end face having portions defining a fitting portion, said male die being associated with said female die with said protrusion part being fitted in said die cavity and with said fitting portion being fitted in said fitting recess;

wherein said protrusion part of said male die is provided between said opposite faces so as to protrude from said end face, and wherein said opposite faces of said male die are removed towards said protrusion part to provide inclined surfaces defining regions for flowing billets.

21. An extrusion die insert as recited in claim 20, wherein said protrusion part is of a comb-shape having a plurality of protruding pieces.

22. An extrusion die insert as claimed in claim 20, wherein said female die includes a notch formed therein for preventing twisting thereof when said female die is held by the holder.

23. An extrusion die insert to be detachably held by a die holder, said extrusion die insert comprising:

a female die of a generally cylindrical shape having opposite end surfaces and including a die cavity formed therein so as to open into one of said end surfaces and a discharge passageway communicated with said die cavity and opening into the other of said end surfaces, said female die including a fitting recess having a generally channel-shaped cross-section formed in said one end surface thereof; and a male die of a generally plate shape having opposite faces and an end face joining said opposite faces, said male die having a protrusion part formed on said end face, said opposite faces and said end face having portions defining a fitting portion, said male die being associated with said female die with said protrusion part being fitted in said die cavity and with said fitting portion being fitted in said fitting recess;

wherein said female die has an axis and includes a cross-shaped recess formed in said one end surface thereof and having first and second grooves intersecting each other at said axis, said first groove defining a billet chamber of a generally rectangular-shaped cross-section while said second groove serves as said fitting recess.

24. An extrusion die insert as recited in claim 21, wherein at least said male die is made of a hard material selected from the group consisting of a tool steel for use in hot working and a high speed steel.

25. An extrusion die insert as recited in claim 21, wherein each of said dies has a hard coating formed thereon.

26. An extrusion die insert as recited in claim 25, wherein said hard coating comprises a nitride coating.

27. An extrusion die insert as recited in claim 23, wherein said first groove is formed so as to open to an outer peripheral surface of said female die.

28. An extrusion die insert as recited in claim 23, wherein said die cavity is disposed at the intersection of said first and second grooves and extends along said axis of said female die, said die cavity having a cross-section of an elongated shape extending longitudinally of said second groove, said discharge passageway being disposed in alignment with said die cavity and being of a topless pyramid-shape having a width increasing in a direction away from said die cavity.

29. An extrusion die insert as recited in claim 23, wherein said male die includes a stepped portion formed on said end face so as to define an engaging portion, said female die including a shoulder portion formed at the intersection of said first and second grooves and held in engagement with said engaging portion, whereby said male die is prevented from being shifted longitudinally of said second groove with respect to said female die.

30. An extrusion die insert as recited in claim 23, wherein said opposite faces of said male die have contact portions held in contacting engagement with said second groove of said female die.

* * * * *